US006432031B1

(12) United States Patent
Paasonen et al.

(10) Patent No.: US 6,432,031 B1
(45) Date of Patent: Aug. 13, 2002

(54) ROLL HAVING A COMPOSITE COVER

(75) Inventors: Jan A. Paasonen, Kerava (FI); Bertram Staudenmaier, Kreuzau-Bilstein (DE)

(73) Assignee: Stowe Woodward Inc., Southborough, MA (US)

( * ) Notice: Subject to any disclaimer, the term of this patent is extended or adjusted under 35 U.S.C. 154(b) by 0 days.

(21) Appl. No.: 08/833,042

(22) Filed: Apr. 3, 1997

Related U.S. Application Data

(60) Provisional application No. 60/014,884, filed on Apr. 4, 1996.

(51) Int. Cl.[7] ..... B23P 15/00
(52) U.S. Cl. ..... 492/56; 492/48
(58) Field of Search ..... 492/56, 59, 54, 492/53, 48

(56) References Cited

U.S. PATENT DOCUMENTS

| | | | | |
|---|---|---|---|---|
| 3,184,828 A | | 5/1965 | Dames, Jr. | 29/129 |
| 3,698,053 A | * | 10/1972 | Meso et al. | 492/56 |
| 3,800,381 A | | 4/1974 | Brafford | 29/132 |
| 3,959,573 A | * | 5/1976 | Eddy et al. | 492/56 |
| 4,258,089 A | | 3/1981 | Anderson et al. | 427/318 |
| 4,288,058 A | | 9/1981 | Inman | 249/134 |
| 4,309,803 A | | 1/1982 | Blaszak | 29/130 |
| 4,368,568 A | | 1/1983 | Watanabe | 29/130 |
| 4,551,894 A | | 11/1985 | Beucker | 29/130 |
| 4,576,845 A | | 3/1986 | Krotchko | 428/36 |
| 4,705,711 A | | 11/1987 | Perna | 428/141 |
| 4,760,232 A | | 7/1988 | Smith | 219/61 |
| 4,842,944 A | | 6/1989 | Kuge et al. | 428/451 |
| 5,091,027 A | | 2/1992 | Watanabe | 156/172 |
| 5,376,448 A | | 12/1994 | Suzuki et al. | 428/382 |
| 5,415,612 A | * | 5/1995 | Carlson et al. | 29/895.32 |
| 5,541,001 A | * | 7/1996 | Vreeland et al. | 492/56 |
| 6,056,230 A | * | 5/2000 | Peters et al. | 242/541.5 |
| 6,148,275 A | * | 11/2000 | Papamarcos et al. | 439/490 |
| 6,224,526 B1 | * | 5/2001 | Stimmelmayr et al. | 492/56 |

FOREIGN PATENT DOCUMENTS

| | | | |
|---|---|---|---|
| JP | 02259186 | 10/1990 | D21G/1/00 |

* cited by examiner

*Primary Examiner*—I Cuda Rosenbaum
(74) *Attorney, Agent, or Firm*—Myers Bigel Sibley & Sajovec

(57) ABSTRACT

The problems caused by chemical and thermal shrinkage of hard roll covers, are reduced by the inclusion of one or more intermediate compressive layers between a roll core base and cover. The compressive layer has the properties of being rigid enough to allow the cover to be applied to the roll, and compressible enough to deform and absorb the stresses which occur as the cover is shrinking during processing. In one embodiment, the compressive layer is separately cast with the cover over a disposable inner mold so as to form a composite roll cover. The composite roll cover is fitted over a roll core base and the resulting circumferential cavity is then filled with a thermoset resin.

21 Claims, 7 Drawing Sheets

ROLL HAVING A COMPOSITE COVER

RELATED APPLICATIONS

This application claims the benefit of U.S. Provisional Application Serial No. 60/014,884, filed Apr. 4, 1996.

FIELD OF INVENTION

This invention relates generally to covered rolls for industrial applications, and more particularly to rolls with relatively hard covers.

BACKGROUND OF THE INVENTION

Covered rolls are used in demanding industrial environments where they are subjected to high dynamic loads and temperatures. For example, in a typical paper mill, large numbers of rolls are used not only for transporting the web sheet which becomes paper, but also for processing the web itself into finished paper. These rolls are precision elements of the system which should be precisely balanced with surfaces that are maintained at specific configurations.

One type of roll that is subjected to particularly high dynamic loads is a calendar roll. Calendaring is employed to improve the smoothness, gloss, printability and thickness of the paper. The calendaring section of a paper machine is a section where the rolls themselves contribute to the manufacturing or processing of the paper rather than merely transporting the web through the machine.

In order to function properly, calendar rolls generally have extremely hard surfaces. For example, typically calendar rolls are covered with a thermoset resin having a Shore D hardness between 84–95 and an elastic modules between 1,000–10,000 MPa. Most commonly, epoxy resins are used to cover calendar rolls because epoxy resins form extremely hard surfaces. Epoxy resins with characteristics suitable for forming the surfaces of calendar rolls are cured at relatively high temperatures (in the range of 100–150° C.).

It is well known that an increase in curing temperature for heat resistant thermoset resin systems typically indicates an increased thermal resistance of the resulting cover. Present day demands of paper mills require rolls, particularly calendar rolls, with higher thermal resistances. Thus, it is desirable to produce covers for such rolls which can be cured at 150–200° C.

However, curing at such high temperatures can cause so much residual stress within the cover that it tends to crack, rendering it unusable. A discussion of the physical chemistry of such a roll cover can be found in a paper entitled, "The Role Of Composite Roll Covers In Soft And Super Calendaring," J. A. Paasonen, presented at the 46ème Congres Annuel Atip, Grenoble Atria World Trade Center Europole, Oct. 20–22, 1993, the teachings of which are incorporated herein by reference. Indeed, one important challenge to the manufacture of roll covers is to develop roll covers that can withstand the high residual stresses induced during manufacturing. Problems from residual stresses are most significant in harder compounds and often result in cracking, delamination, and edge lifting. In addition, residual stresses often cause premature local failure or shorter than desired life cycles. This is especially true for high performance, hard polymeric roll coverings, for which the basic approach has been to tolerate a production level of residual stresses that is still acceptable for product performance. Therefore, there is a need to develop methods of roll cover construction that reduce residual stresses in the product.

Consideration of residual stresses is especially critical during the manufacture of the roll cover. In particular, heating and curing processes must be given careful consideration, as these conditions are often the most significant factors in the development of such stresses. Residual stresses most often develop in polymer based covers as a result of the mismatch in thermal shrinkage properties between and/or among the cover materials and the core materials and from chemical shrinkage. Polymers typically have a coefficient of thermal expansion that is an order of magnitude greater than that of steel, the typical material of the core.

One suggestion to alleviate stresses caused by processing covered rolls is to produce a cover as a finished product and bond the fully cured cover to a core structure. This can be accomplished by wrapping a cover (topstock) over a mold, then demolding and bonding the cover to a core structure at a lower temperature level than the cover cure temperature, or by casting the cover separately and bonding it to a metal core at a lower temperature than the casting temperature.. Under these processes, the thermal stresses that would arise between the cover and the core from cooling the cover should be reduced.

Unfortunately, although adhesives for bonding the cover to the core are available, some adhesives exhibit poor bonding strengths when the roll is subjected to industrial applications. In general, adhesives that are suitable for high temperature performance also cure at high temperatures. Thus, subjecting the core to high temperature bonding conditions can result in stresses that were avoided by separately producing the cover.

In addition, manufacturing costs would be increased by producing the cover first as a separate cylindrical structure, then fitting it over a roll core at a lower processing temperature than was required for processing the cover. These casting methods require that an open cavity be created between the cover and the roll core, which necessitates multiple process steps and the use of inner mandrels. Even if the cover is separately manufactured via a centrifugal casting method, additional costs and steps are required for an outer mold.

Another possible solution is to develop a cover material having a thermal shrinkage as close to the metallic core as possible. While composite structures may be developed with the expansion coefficients tailored to match the metal core, such methods are expensive and may not produce the desired thermomechanical response for certain industrial applications. Thus, the need exists to develop methods to reduce the residual stress levels in current production materials.

SUMMARY OF THE INVENTION

In view of the foregoing, it is an object of this invention to reduce the problems caused by chemical and thermal shrinkage that develop during the manufacture of a covered roll.

The problems caused by chemical and thermal shrinkage of hard roll covers are reduced in accordance with the present invention by separately casting the cover with the inclusion of at least one intermediate compressive layer over a disposable inner mold. The inner mold is formed of a material that is rigid enough to support the cover during processing, and easily removed and discarded after processing. The intermediate layer which is applied over the mold is compressible enough to deform and absorb the stresses which develop as the cover is shrinking during processing.

The problems caused by chemical and thermal shrinkage are further reduced in accordance with the present invention through a method comprising the steps of applying the intermediate compressive layer over a disposable inner mold, applying a polymeric cover material over the intermediate compressive layer, and curing the cover material into a cylindrical cover at an elevated temperature. Next, the cover is permitted to shrink during curing or hardening, and the disposable inner mold is disposed of. The roll is completed by applying the cylindrical cover over a roll core base to form an intermediate roll having a circumferential gap layer, sealing both ends of the intermediate roll, and filling the gap layer with a filler material.

In another embodiment of the present invention, a metal roll core having an applied base layer is substituted in place of the disposable mold. An intermediate layer comprising a wax or other dissolvable material is applied over the roll base. The cover is then cast or wrapped over the intermediate compressive layer and roll base. Then the intermediate layer is dissolved away and the resulting gap is filled with an adhesive layer.

DETAILED DESCRIPTION OF THE PREFERRED EMBODIMENTS

The present invention will now be described more particularly hereinafter with reference to the accompanying drawings, in which present embodiments of the invention are shown. The invention may, however, be embodied in many different forms and is not limited to the embodiment set further herein; rather, these embodiments are provided so that the disclosure will fully convey the scope of the invention to those skilled in this art.

At the outset, the roll having a composite roll cover and the process for making the covered roll are described in their broadest overall aspects with a more detailed description following. In general, high performance covered rolls are manufactured with reduced residual stresses through a method which casts or wraps a composite roll cover as a separate step to form a tube-like cylindrical structure.

In a primary processing phase, an intermediate compressive layer is applied over a disposable inner mold or mandrel. An outer mold is fitted over the intermediate compressive layer and inner mold assembly so as to create a first circumferential gap layer between the intermediate layer and the outer mold. This first circumferential gap layer is filled with a polymer material.

The purpose of the intermediate compressive layer is to absorb the thermal stresses and chemical volume changes created during the processing of the gap layer. After an initial cure of the first circumferential gap layer, the inner mold is discarded. Further, post-curing of the resulting cylindrical tube-like structure forms a finished composite cover.

In a secondary processing phase, the resulting composite cover is applied circumferentially to a prepared metal roll core. This step creates a second circumferential gap layer that is intermediate to the cover and the core. In a final processing step, the second circumferential gap layer is filled, preferably with a thermoset resin which is cured at a lower temperature than that of the cover.

Figure 1:
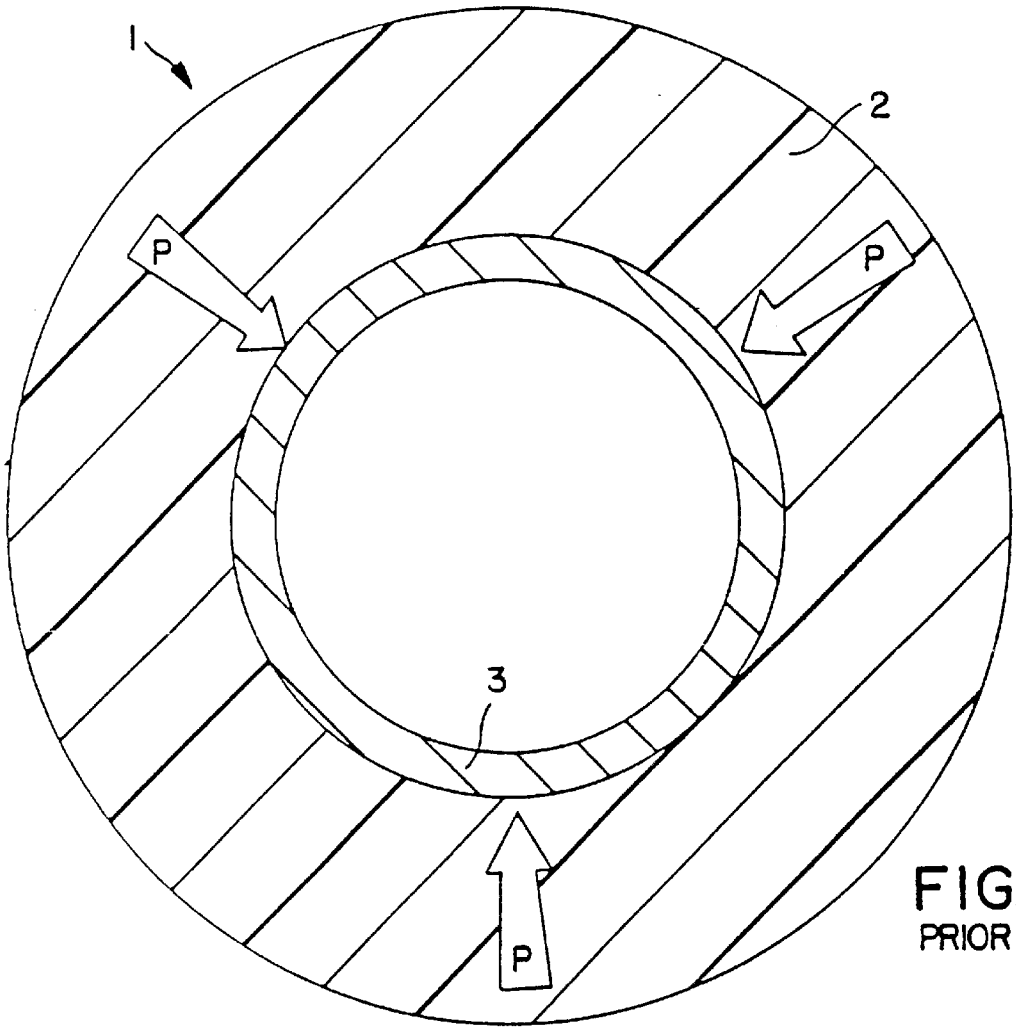
FIG. 1 PRIOR ART
FIG. 1 is a cross sectional view of a prior art roll having a multi-layered covering which diagrammatically shows the thermal and residual stresses within the cover directed towards the metal roll core.

With reference now to the drawings, FIG. 1 shows a covered roll 1 of the prior art. The arrows identified by the letter P in FIG. 1 indicate how residual stresses and thermal shocks within the cover 2 are directed towards the metal roll core base 3. Although not indicated by arrows in FIG. 1, the residual stresses and thermal shrinkages occur in other directions within the roll 1 as well, such as axially and radially. Eventually, these internal stresses can lead to premature cracking of the roll 1.

Figure 2:
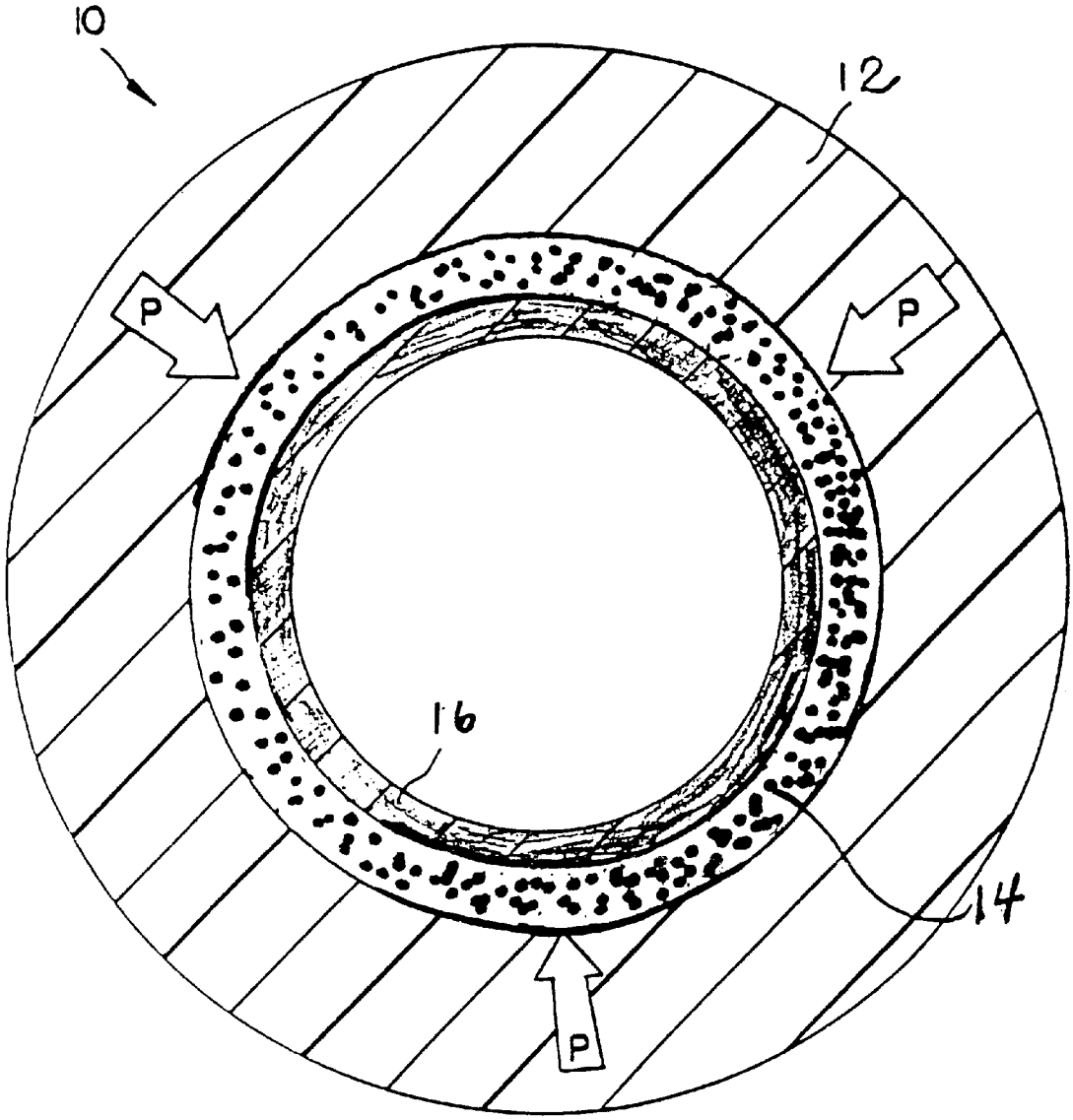
FIG. 2 is a cross-sectional view of a covered roll of the present invention having an intermediate compressive layer applied over a disposable inner mold which diagrammatically shows how the thermal and residual stresses within the cover are absorbed by the intermediate compressive layer.

FIG. 2 shows a composite roll cover 10 comprising a polymer cover layer 12 and an intermediate compressive layer 14 surrounding a disposable inner mold 16 (an outer mold is not shown). The arrows identified by the letter P in FIG. 2 indicate how the intermediate compressive layer 14 allows the cover layer 12 to shrink in the direction as shown during the processing of this layer 12. Although not indicated by arrows in FIG. 2, the intermediate compressive layer 14 allows for shrinkage and shock absorption in axial, radial and other directions within the roll 10.

Figure 3:
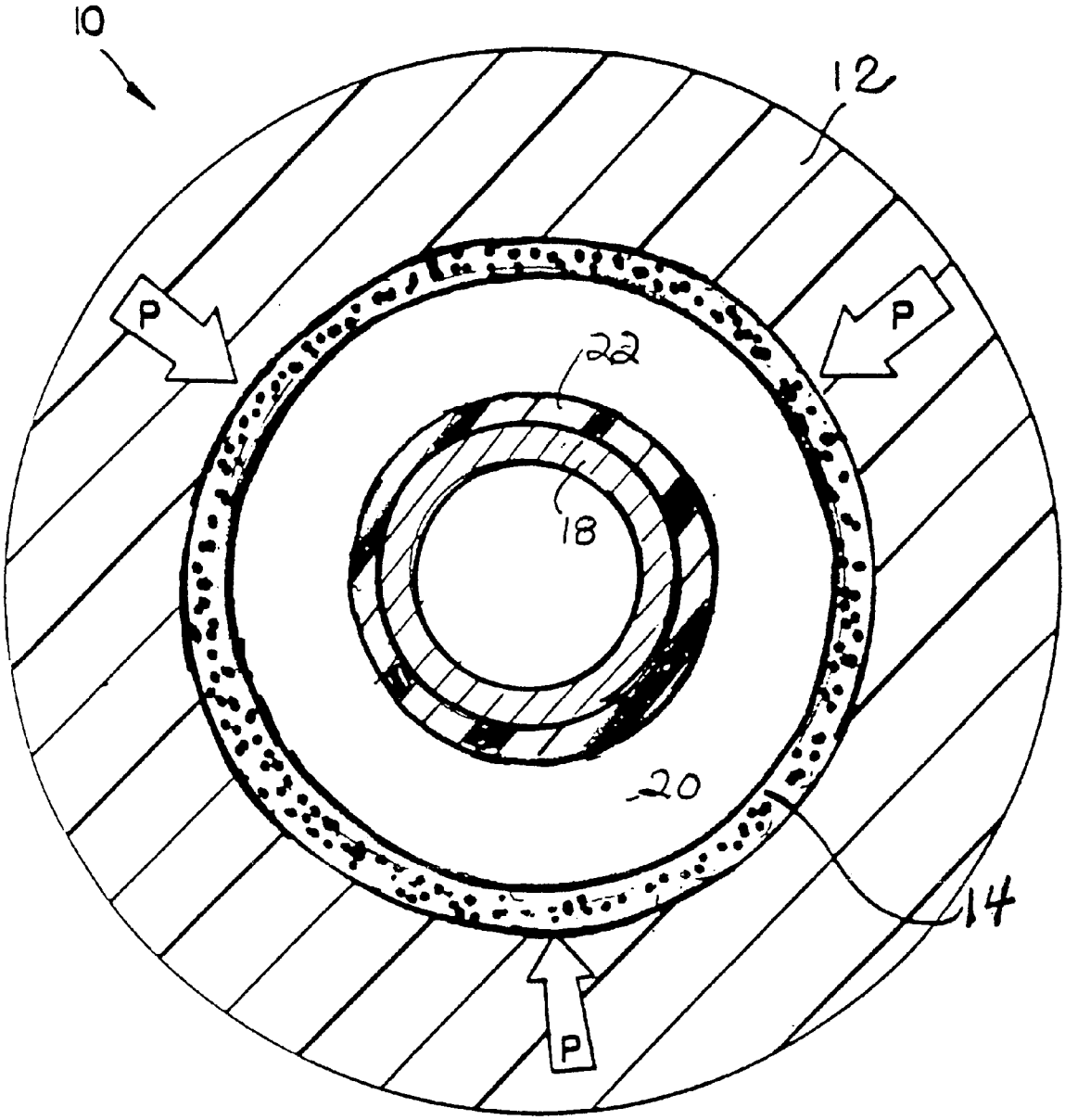
FIG. 3 is a cross-sectional view of a covered roll of the present invention after removing (demolding) the disposable inner mold and fitting the resulting composite cover over a metal roll core base to create a circumferential gap layer.

FIG. 3 shows how, in the secondary processing phase of this embodiment, after discarding the inner mold 16 and post-curing the resulting composite cover 10, the composite cover 10 cover is fitted circumferentially over a prepared metal roll core 18 having an applied base layer 22 so that a second circumferential gap layer 20 is created between the core 18 and the cover 10. In the final stages of production the second circumferential gap layer 20 is filled, preferably with a thermoset resin forming system which cures at a lower temperature than that of the cover layer 12.

Figure 4:
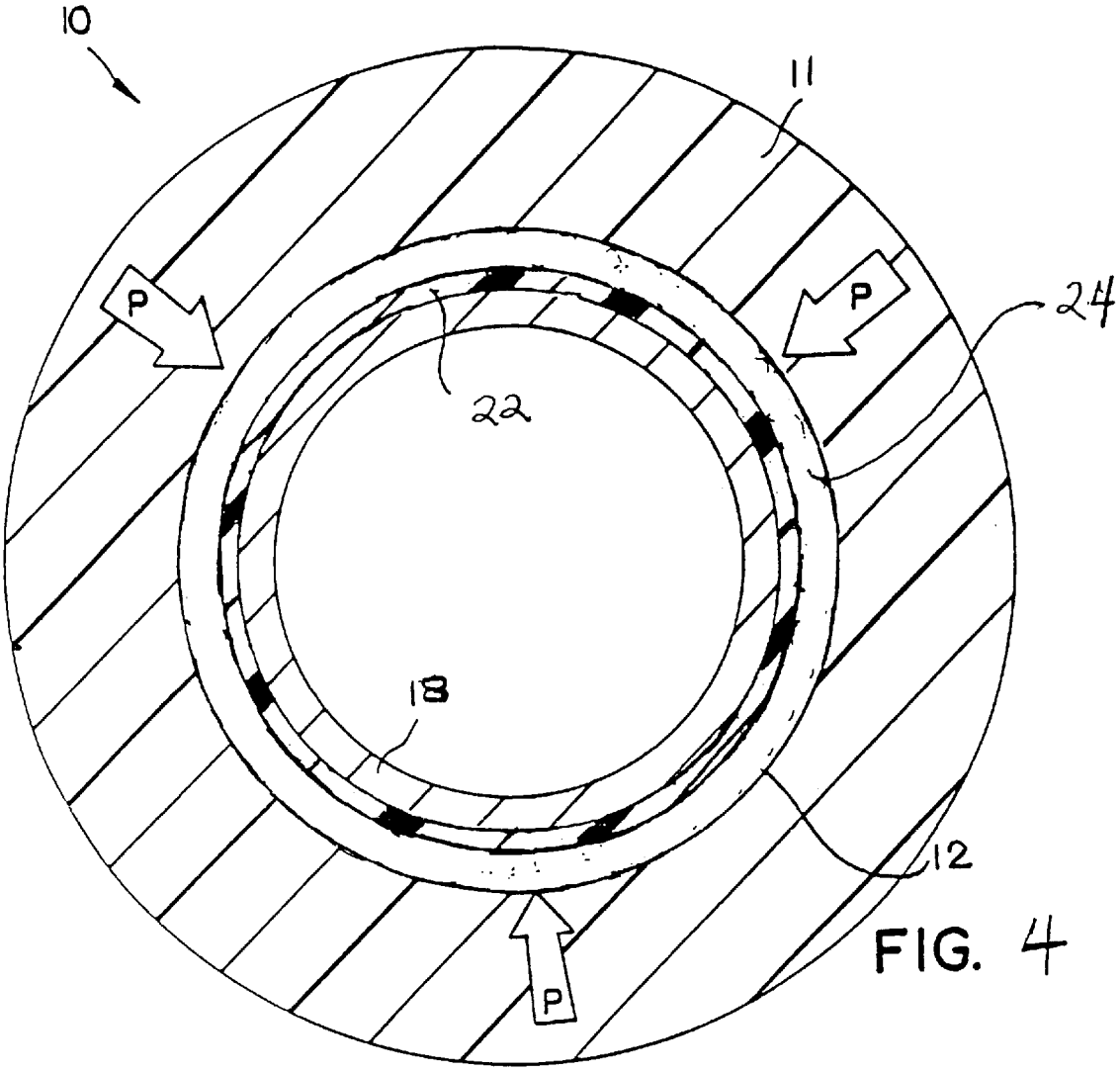
FIG. 4 is a cross-sectional view of a covered roll of the present invention having a dissolvable intermediate compressive layer applied over a polymeric roll core base which diagrammatically shows how the thermal and residual stresses within the cover are absorbed by the intermediate compressive layer.

FIG. 4 shows another embodiment of the present invention wherein the disposable inner mold 16 is not employed; rather, a metal roll core 18 having an applied base layer 22 is substituted for an inner mold ("non-disposable inner mold"). An intermediate layer comprised of a wax or other dissolvable material 24, is applied over this roll base 18. The cover 12 is then either cast or wrapped over the intermediate compressive layer 24, roll base 18, and base layer 22. After absorbing the residual stresses and post-curing, the intermediate layer 24 is dissolved away and the cover 12 removed, and the surface of the roll base 18 is prepared (cleaned up and an adhesive applied). This is followed by replacement of the cover 12 over the roll base 18 and filling of the resulting gap layer with an adhesive layer to form a solid roll.

As will be apparent to one skilled in the art, more than one compressive layer may be used if the roll design so dictates. It should also be readily apparent to one skilled in the art that different kinds of compressive materials may be used as an intermediate layer. The compressive layer is preferably formed from a silicone foam tape, although other materials are suitable. A preferred silicone foam tape is sold under the trade name of SI-Schaum vierkant available from BIW Isolierstoffe GmbH, Postfach 11 15, D-58240, Ennepetal, Germany. Typically, this material is purchased in 150 by 4 mm strips and has a shore G hardness in the range of 8–15 (tolerance 10%).

As is explained in detail below, the filling material used to fill the gap between the cover 12 and the core 18 is typically a resin system similar to the resin system used to form the cover, but which cures at a lower temperature than the cover.

Figure 5:
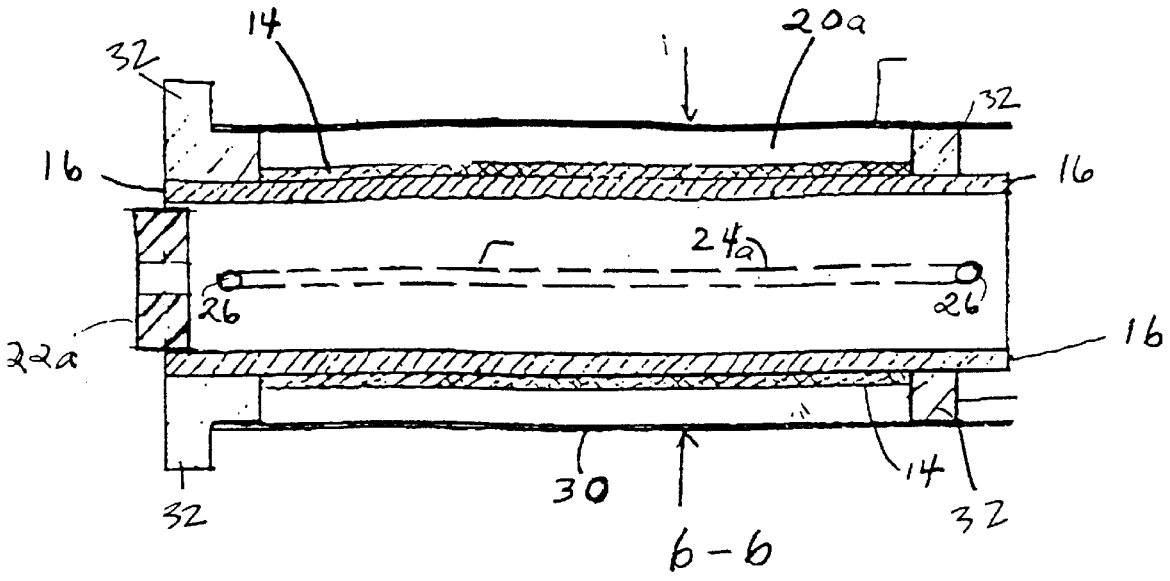
FIG. 5 is a longitudinal-sectional view of a covered roll of the present invention having a first circumferential gap layer and compressive layer surrounding a disposable inner mold.
Figure 6:
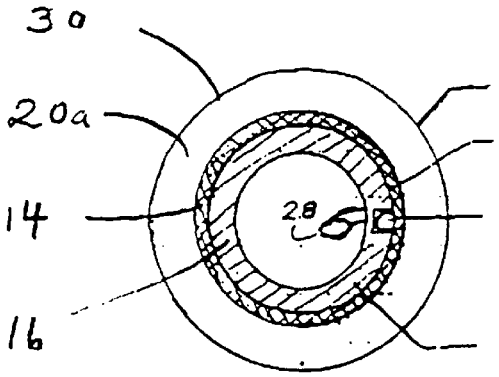
FIG. 6 is a cross-sectional view of FIG. 5 taken along lines 6—6.

In manufacturing a roll in accordance with the embodiment of FIGS. 2 and 3 and with reference to FIGS. 5 and 6, the disposable inner mold 16 is sized to the desired length of the roll cover 12. Preferably, the disposable inner mold 16 is formed of cardboard, but other suitable disposable materials can be used. Wooden rings 22*a* are fitted ("corked") inside both ends of the inner mold 16 to provide structural rigidity (only the left wooden ring 22*a* is shown in FIG. 5). As known in the art, other structures may be used for supporting the inner mold 16, such as wooden plugs or plugs made out of a suitable temperature resistant material.

A groove, illustrated with phantom lines at 24*a*, is machined longitudinally along the length of the mold 16 to a distance of approximately 10 cm from each end (groove 24*a* does not penetrate through the mold). Through holes 26 are drilled into the mold interior at each end of the groove. A cable 28 is nestled into the groove and through the interior of the mold 16 to form a continuous loop.

The inner mold 16 is wrapped with a compressive material to form the layer 14. The wrapping is done preferably in two passes to create an overlap. The preferable material for the compressive layer is a silicone foam material. The silicone foam tape is preferable because of its high release properties, as it tends not to stick to the inner mold 16 after processing. During processing, the silicone foam tape acts an intermediate compressive layer 14 between the inner mold 16 and the cover layer 12.

An outer metal mold 30 is fitted over the inner mold 16 and silicone compressive layer 14 to form a first circumferential gap layer 20*a*. The ends of the first circumferential gap layer 20*a* are sealed with end-seals 32 and caulk. Preferably, the end-seals 32 are formed out of wood; however, any suitable sealing material capable of withstanding the processing temperatures can be used. The end-seals 32 are preferably ring shaped so as to fit in space between the intermediate layer 14 and the outer mold 30. The metal outer mold 30 has a thin ring-like extension on one end. The ring-like extension has eye-hooks attached for vertically supporting the mold assembly. As known in the art, attachments for vertically supporting the roll can be accomplished in a variety of ways, such as drilling holes into tabs extensions.

At least one end of the metal outer mold is drilled, tapped and equipped with at least one inlet port and valve (not shown). A suitable resin material is pumped into the first circumferential gap layer 20*a* through the valve and inlet port.

During casting, the mold assembly is maintained in a vertical or near vertical position while the resin material gels. The initial temperature of the resin material is in the range of 40–45° C. During the curing process, the residual stresses are absorbed by the compressive layer 14 and reduce the tendency of the roll to crack. Then, the roll is demolded, which includes the step of discarding the inner mold by pulling the cable 28 to collapse the inner mold 16. The resulting composite cover 10 is further cured in an oven without the need for any supporting structures.

Following the post-cure of the composite cover, the inner cylindrical cavity of the composite cover is prepared by a suitable blasting media, such as, grit blasting. The composite cover 10 now comprises a tube-like cylindrical structure which is ready to be applied over a suitable roll core base.

Figure 7:
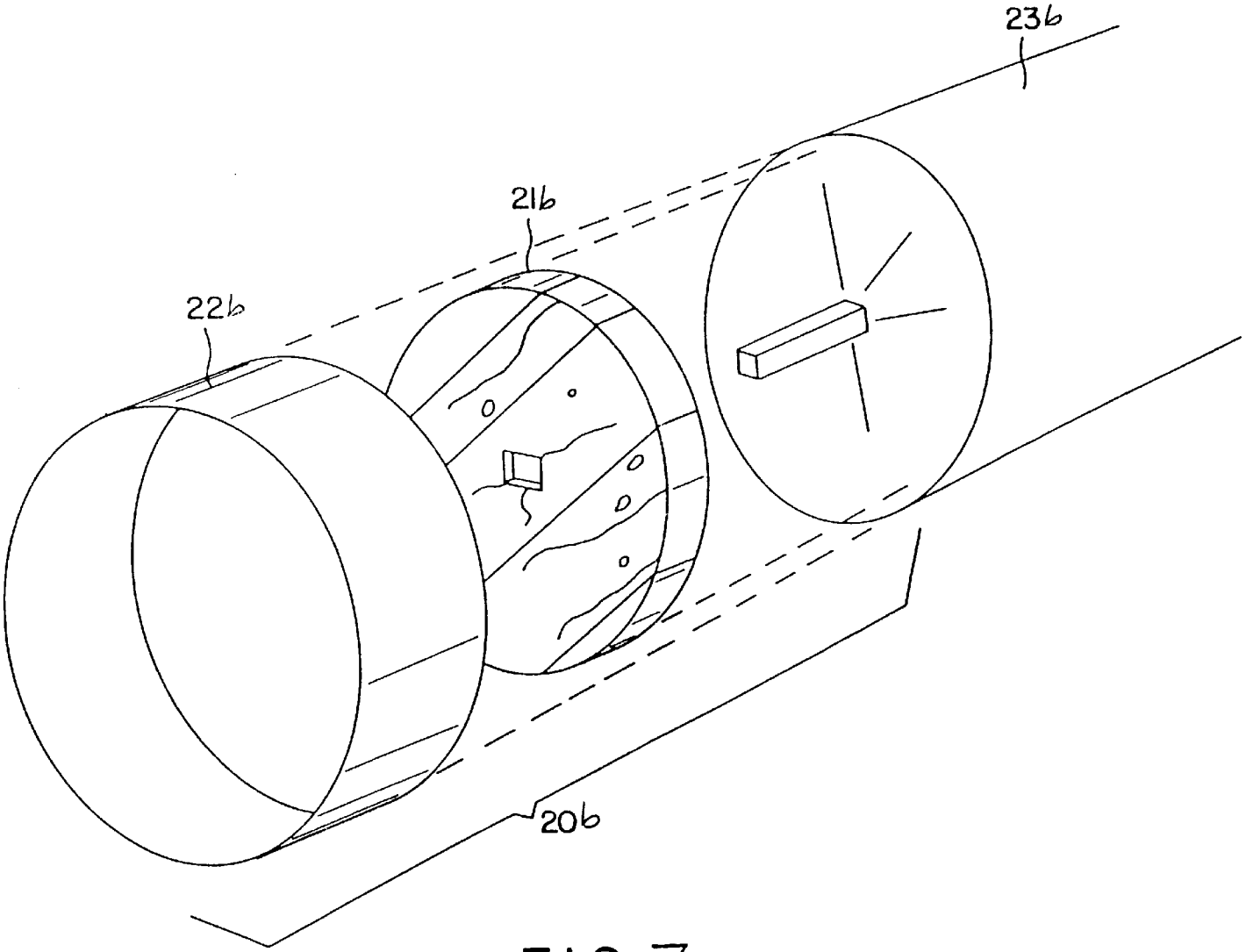
FIG. 7 is an exploded perspective view of a metal roll core base and an extender assembly used to assist in the manufacturing of rolls in accordance with the present invention.

As known in the art, a polymer or reinforced polymer layer is applied to a metal roll core as a base layer. The prepared roll with the base layer is fitted with an extension can assembly and end-seals to accommodate the composite cover. To facilitate the filling of the second circumferential gap layer, FIG. 7 shows how an extender cap assembly 20*b* is placed on each end of the prepared roll core base. The extender cap assembly comprises a substantially circular plate 21*b* and a cylindrical section 22*b*. Preferably, the plate 21*b* is made out of wood and the cylindrical section is made of the same material as the roll core base 23*b*. However, other suitable extender cap assemblies can be made entirely out of wood or other equivalent materials, and may include other configurations, such as annular rings with a bolt-on top plate or other cap shapes, including shoulder plates integral with the ring, and equivalents thereof.

Figure 8:
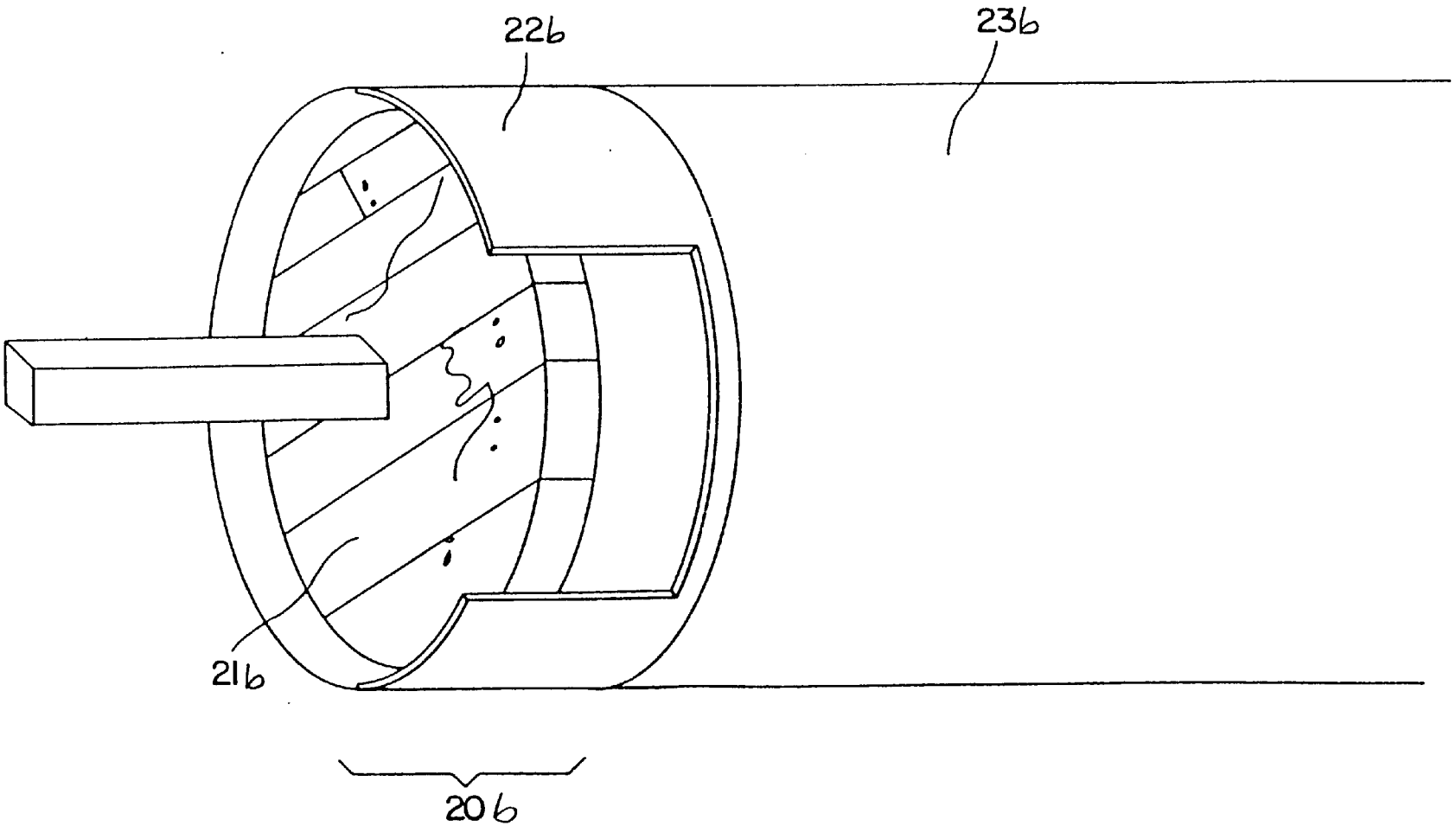
FIG. 8 is a perspective view of an extender assembly as it is fitted flush with the surface of a metal roll core base in accordance with the present invention.

FIG. 8 is a perspective and cut-away view of the extender can assembly 20*b* in place on one end of the metal roll core base 23*b* prior to the application of any layers, and shows how the outer circumference of the cylindrical section 22*b* matches the circumference of the metal roll core base 23*b*.

The composite cover is sleeved over the roll core base and positioned with an end seal on the bottom end and a collar at the top end. The assembled roll is then placed in the vertical casting station. A journal extension is used to fix the roll in the station. A filler material is pumped into the second circumferential gap layer. As before, the filler material is allowed to gel at room temperature. Then the entire assembly is post-cured in an oven at 60–80° C. It is an important aspect of the present invention that the second circumferential gap layer 20 is filled with a polymer that cures at a lower temperature than the cover layer 12, thus providing strength to the finished roll and reducing the likelihood of roll cover 10 cracking.

Rolls in accordance with the present invention can utilize two systems which yield two different polymers upon curing. The polymer forming the cover, is preferably a thermoset resin and can be any polymer normally used in the art. Most commonly an epoxy resin is used for the cover, such as an epoxy resin based on a Diglycidylether of Disphenol A, commercially known as DER 331 from Dow Chemical Co. This can be cured in a temperature range from 130–150° with an aromatic amine, such as Diethylenetoulenediamine (DETDA 80) from Lonza Aq, Switzerland. Alternatively, the cover can be made from a Cyanate Ester modified Novolac Resin system supplied from Allied Signal Inc., U.S.A.

Preferably, the second circumferential gap layer is filled with a thermoset forming system that cures at a lower temperature than the polymer system used for the topcoat. The second circumferential gap layer can be filled with a resin; the filler material for the second circumferential gap layer is preferably a thermoset resin. As with the cover, the preferred epoxy resin is based on a diglycidylether of Disphenol A, commercially known as DER 331 from Dow Chemical Co., but cured in the temperature range of 70–90° C. with a suitable aliphatic amine, such as Jeffamine T-403 supplied by Texaco Chemical Co., U.S.A.

In an exemplary embodiment, the circumferential gap layer is filled with a thermoset or thermoplastic polymer under such conditions in which the development of higher than desired residual stresses in the cover and also in the circumferential gap layer itself can be prevented. For base systems which require high temperature resistance, tailored thermoset resin systems may be used in a way that the glass transition temperature in the base can be adjusted to the required level.

The composite roll cover and the method of making a covered roll using circumferential gap layers are further illustrated with the following specific example of a Duren casting procedure.

1. A cardboard mold is used for the inner mold. It is equipped with wooden rings to provide additional structural support at each end. Two slots are machined down the length of the mold except for approximately 10 cm on each end. Through holes are drilled at the ends of the slots. A metal cable is nested in the slot and drawn through the through holes into the inner mold. This cable is used to collapse the mold after the cast.

2. The prepared mold is wrapped with two passes of a silicone foam material. This foam provides a compressible surface during casting and is not adhesive to the matrix.

3. A metal outer mold is sleeved over the prepared paper mold and fitted with caulk against the prepared end-seal.

4. The metal mold is tapped and equipped with an inlet port and valve.

5. The fillers are sifted into a mixing vat through a vibrating 60 mesh screen into the pre-weighed resins. The material is then mixed and screened again. The vibration equipment reportedly greatly improved the screening time. The resin is heated and degassd. The pre-weighed curative component is added and mixed for ten minutes. The material is then pressurized to fill the prepared mold. Typically, three tubes may be cast with one batch of material. The mold assembly is held vertical during casting and gels with its exotherm. The initial temperature is 40–45° C. The batch size is up to 2000 kgs.

6. The tube is demolded and then post-cured in the oven. No special support is needed during the post-cure step.

7. The ID of the tube is then prepared by grit-blasting. The tube is tapped to receive the intermediate layer filling ports.

8. A standard PU base layer is applied to the core. The core is equipped with extension cans and end-seals to accommodate the tube.

9. An extension arm is attached to one end of the prepared core. This arm is used to support the roll while the tube is being sleeved on.

10. The cast tube is sleeved on and positioned with the end seal at the bottom end and with a collar at the top end.

11. The assembled roll is placed in the vertical PU casting station. A journal extension is used to fix the roll in the station. The intermediate layer is simply mixed and pressurized through lines attached to the two valve-equipped portals. The material gels at room temperature. The entire assembly is post-cured at 60–80° C.

In the foregoing specification, the invention has been described with reference to specific exemplary embodiments thereof. It will, however, be evident that various modifications and changes may be made thereunto without departing from the spirit and scope of the invention as set forth in the appended claims. The drawing and specification are, accordingly, to be regarded in an illustrative rather than in a restrictive sense.

That which is claimed:

1. A covered roll structure employed in the manufacture of a paper machine roll, said structure comprising:

a core mold having a substantially cylindrical outer surface;

a sleeve of compressible material surrounding said core mold outer surface, wherein said sleeve of compressible material has a Shore G hardness of 8 to 15; and a sleeve of polymeric material surrounding said sleeve of compressible material.

2. The covered roll structure according to claim 1, wherein the compressible material comprises an inorganic material.

3. The covered roll structure according to claim 1, wherein the polymeric material comprises an epoxy.

4. The covered roll structure according to claim 1, wherein the compressible material comprises silicone foam.

5. The covered roll structure according to claim 1, wherein said core mold comprises paperboard and wherein said core mold is configured to be removable from the covered roll structure.

6. A covered roll structure employed in the manufacture of a paper machine roll, said structure comprising:

a collapsible core mold having a substantially cylindrical outer surface;

a sleeve of compressible material surrounding the outer surface of the collapsible core mold; and a sleeve of polymeric material surrounding the sleeve of compressible material.

7. The covered roll structure according to claim 6, wherein the outer surface of the collapsible core mold includes a longitudinal groove.

8. The covered roll structure according to claim 7, wherein the groove does not penetrate through the core mold.

9. The covered roll structure according to claim 7, wherein the core mold has a first mold end and a second mold end and the groove has a first end-point and a second end-point and wherein at least one of said first and second end-points is about 10 centimeters from at least one of said first and second mold ends.

10. The covered roll structure according to claim 7, wherein a cable is positioned within the groove.

11. The covered roll structure according to claim 10, wherein the cable has a diameter and the groove has a depth and wherein the diameter of the cable is substantially equal to the depth of the groove.

12. The covered roll structure according to claim 6, wherein the core mold has an inner surface, said inner surface defining a void space, and wherein the cable is a continuous loop having a portion of its length in said void space.

13. The covered roll structure according to claim 7, wherein at least two longitudinally spaced through holes are positioned within the groove.

14. The covered roll structure according to claim 13, wherein the groove has a first end-point and a second end-point and wherein a first through hole is positioned at said first end-point and a second through hole is positioned at said second end-point.

15. The covered roll structure according to claim 14, wherein a cable is positioned within the groove and wherein said cable extends through the first and second through holes.

16. The covered roll structure according to claim 15, wherein the core mold has an inner surface, said inner surface defining a void space, and wherein the cable is a continuous loop having a portion of its length in said void space.

17. The covered roll structure according to claim 6, wherein the compressible material comprises an inorganic material.

18. The covered roll structure according to claim 6, wherein the polymeric material comprises an epoxy.

19. The covered roll structure according to claim 6, wherein the compressible material comprises silicone foam.

20. The covered roll structure according to claim 6, wherein the collapsible core mold comprises paperboard.

21. The covered roll structure according to claim 6, wherein the collapsible core mold is a unitary structure.

* * * * *